United States Patent [19]

Simons

[11] Patent Number: 4,624,903

[45] Date of Patent: Nov. 25, 1986

[54] DISPERSIONS OF WATER-INSOLUBLE PHOTOGRAPHIC ADDENDA WITH PETROLEUM SULFONATE

[75] Inventor: Michael J. Simons, Ruislip, United Kingdom

[73] Assignee: Eastman Kodak Company, Rochester, N.Y.

[21] Appl. No.: 800,199

[22] Filed: Nov. 21, 1985

[30] Foreign Application Priority Data

Nov. 23, 1984 [GB] United Kingdom ..... 8429678

[51] Int. Cl.[4] ..... G03C 1/04; G03C 1/38; G03C 1/40; G03C 1/84

[52] U.S. Cl. ..... 430/14; 252/353; 430/449; 430/493; 430/510; 430/512; 430/531; 430/546; 430/559; 430/566; 430/629; 430/636

[58] Field of Search ..... 430/546, 636, 629, 493, 430/14, 510, 512, 531, 559, 566, 449; 252/333, 353

[56] References Cited

U.S. PATENT DOCUMENTS

| | | | |
|---|---|---|---|
| 2,388,677 | 11/1945 | Cohen | 252/353 |
| 3,223,648 | 12/1965 | Plapper et al. | 252/353 |
| 3,912,517 | 10/1975 | Poucke et al. | 430/546 |
| 4,140,530 | 2/1979 | Trunley et al. | 430/546 |
| 4,146,399 | 3/1979 | Trunley et al. | 430/546 |
| 4,211,836 | 7/1980 | Yoneyama et al. | 430/449 |

FOREIGN PATENT DOCUMENTS 1274523 5/1972 United Kingdom .

OTHER PUBLICATIONS

"Anionic Surfactants", Surface Science Series, vol. 7, edited by W. M. Linfield, Dekker, N.Y., 1976, vol. II, pp. 315–343.

*Primary Examiner*—Richard L. Schilling
*Attorney, Agent, or Firm*—Richard E. Knapp

[57] ABSTRACT

Liquid petroleum sulfonates are useful alone or in combination with less lipophilic anionic surfactants in the preparation of dispersions of water-insoluble photographic addenda, such as couplers and ultraviolet absorbers, in hydrophilic colloid compositions. Such dispersions are useful in photographic elements. Crystallization of the addenda is inhibited and, for some addenda, other advantages are obtained.

7 Claims, No Drawings

DISPERSIONS OF WATER-INSOLUBLE PHOTOGRAPHIC ADDENDA WITH PETROLEUM SULFONATE

This invention relates to dispersions of water-insoluble photographic addenda, such as dyeforming couplers and ultraviolet radiation absorbers, and to photographic materials comprising such dispersions.

It is often necessary in the manufacture of photographic materials, both radiation-sensitive and otherwise, to incorporate a water-insoluble compound into a hydrophilic colloid layer in such a way that the compound cannot diffuse in, or away from, the layer either during the coating and drying of that layer or during its subsequent wet-processing. A well-known method of achieving this object, and that with which the present invention is concerned, comprises dispersing the compound with the aid of an anionic surfactant in an aqueous hydrophilic colloid solution and using the dispersion so obtained as a constituent for the composition to be used in forming the layer. To facilitate the dispersion process, and provide certain other advantages, the compound may be dispersed in a mixture with an involatile organic compound, termed an "oil-former" or "coupler solvent", so that it is present in the final dispersion as very fine oily droplets. It is desirable to use as little of the oil-former as possible because its presence both increases the bulk and reduces the strength of the layer. However, when a very small amount of oil-former is employed, the addendum-oil-former mixture constitutes, in many instances, a highly supersaturated solution so that the addendum may crystallize and lead to blemishes and undesired optical effects in the finally coated layer.

The anionic surfactants used for dispersion manufacture have conventionally been hydrophilic alkyl or alkaryl sulphates or sulfonates.

Solid petroleum sulfonates have been suggested, among many other types of surfactants, as constituents for water-dispersible tablets in U.S. Pat. Nos. 4,140,530 and 4,146,399. These tablets also contain a water-insoluble photographic addendum and a water-soluble photographically inert solid so that when "dissolved" in water they produce a dispersion of the photographic addendum.

We have discovered that by employing a liquid petroleum sulfonate either as the sole anionic surfactant or in combination with a conventional anionic surfactant, in the manufacture of dispersions of water-insoluble photographic addenda, the tendency of the addenda to crystallise is markedly reduced. With certain addenda other advantages accrue, as described hereinafter.

According to the present invention there is provided a dispersion of a water-insoluble photographic addendum in a hydrophilic colloid composition, which dispersion contains an oil-soluble petroleum sulfonate which is liquid at 20° C.

Also provided in accordance with the invention are a photographic element comprising a support bearing a hydrophilic colloid layer containing a dispersion of the invention and methods of making such a dispersion and such a photographic element.

The liquid petroleum sulfonate is more lipophilic and more complex in constitution than anionic surfactants previously used for preparing dispersions. A liquid petroleum sulfonate is made by treating a petroleum fraction with a sulphonating agent, usually sulphuric acid, sulphur trioxide or oleum, and is a complex mixture of compounds the composition of which depends on the petroleum stock used as the original raw material and on the purification procedure, if any, adopted in the making process. The normal commercial products contain unsulfonated (usually 20 to 60% by weight), as well as sulfonated, material. The sulphonation is believed to occur in aromatic rings of the hydrocarbon mixture. A description of the manufacture, structure and other characteristics of petroleum sulfonates is given in "Anionic Surfactants", Surfactant Science Series, Vol. 7, edited W. M. Linfield, Dekker, New York, 1976, see Vol. II, pp 316ff.

Useful petroleum sulfonates are oil-soluble, being supplied as solutions in unsulfonated material. In fact, it is preferred to use the commercial products as supplied because the unsulfonated material helps prevent crystallisation. However, if it is desired to use a purified petroleum sulfonate, to remove unwanted colored constituents for instance, then the loss of crystallisation inhibiting properties can be prevented by mixing with a substitute oil such as a photographic coupler solvent. The commercial products "Petronate L" and "Petronate HL" (trade marks) used for the Examples hereinafter are believed to contain about 38% by weight of unsulfonated mineral oil. Useful petroleum sulfonate compositions are liquid at 20° C.

A diversity of water-insoluble photographic addenda may be dispersed by a method of the invention, including, for example, couplers, ultraviolet absorbers, dyes, redox dye releasers, developing agents, electron transfer agents, oxidized developer scavengers and image stabilizers. Combinations of such addenda are also useful. Numerous references to patent specifications and other publications describing useful photographic addenda are given in *Research Disclosure,* Dec. 1978, Item No. 17643, published by Kenneth Mason Publications, Ltd. The Old Harbourmaster's, 8 North Street, Emsworth, Hampshire P010 7DD, England. Commonly used dye-forming couplers are phenolic, and naphtholic, compounds which give cyan dyes, pyrazolones and pyrazolotriazoles which give magenta dyes, and active methylene compounds, such as benzoylacetanilides which give yellow dyes. Combinations of couplers are also useful. The following United Kingdom patent specifications, among many others, describe useful couplers.

| | |
|---|---|
| Cyan dye-forming | |
| 562,205 | 939,242 |
| 649,660 | 1,077,873 |
| 797,141 | 1,084,480 |
| 825,311 | 1,153,193 |
| 843,497 | 1,165,563 |
| Magenta dye-forming | |
| 674,161 | 904,852 |
| 680,488 | 956,261 |
| 843,497 | 1,077,875 |
| 868,937 | 1,140,898 |
| 871,936 | 1,183,515 |
| Yellow dye-forming | |
| 595,314 | 1,040,710 |
| 674,161 | 1,077,874 |
| 800,108 | 1,078,338 |
| 843,497 | 1,092,506 |
| 898,005 | 1,474,128 |

It has been found that the oil-soluble petroleum sulfonates improve the dark stability of image dyes formed by color development in the presence of a compound containing a phenolic (including naphtholic) moiety in which the acidity of the phenolic hydroxyl group is enhanced by the presence of at least one electron-withdrawing group in a position ortho or para to that group. Thus these petroleum sulfonates have an effect similar to that of the lipophilic anionic surfactants, specified for use in my copending application Ser. No. 800,260 filed Nov. 21, 1985 (counterpart of British application No. 8429677 filed Nov. 23, 1984).

The phenolic moiety-containing compound may be a substituted cyan coupler as described, for instance, in one of the United Kingdom patent specifications:

| | |
|---|---|
| 562,205 | 825,311 |
| 586,211 | 843,497 |

-continued

| | |
|---|---|
| 627,814 | 1,077,873 |
| 649,660 | 1,165,563 |
| 737,104 | 1,377,233 |
| 797,141 | 1,541,075 |

or it may be a coupler wherein the phenolic moiety does not provide the coupling site, being for instance in a coupling-off group. Couplers of this kind are described in United Kingdom patent specifications Nos. 1,183,515 and 1,474,128.

Examples of couplers which can be dispersed by the method of the invention are given below. These couplers are used in the Examples hereinafter and have therefore been numbered for convenience of reference.

C1

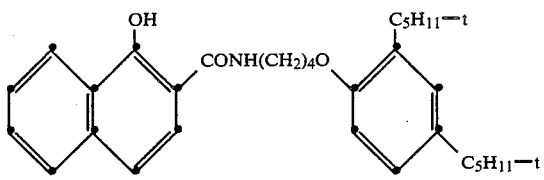

C2

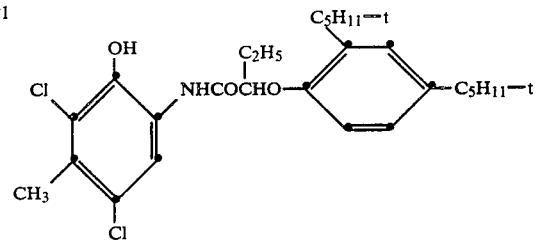

C3

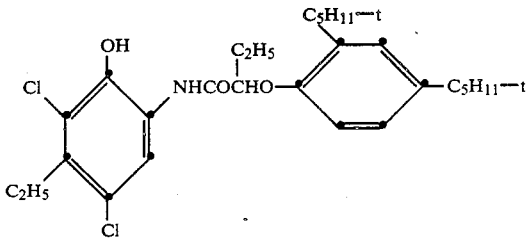

M1

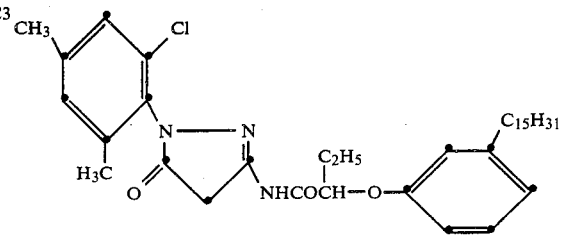

M2

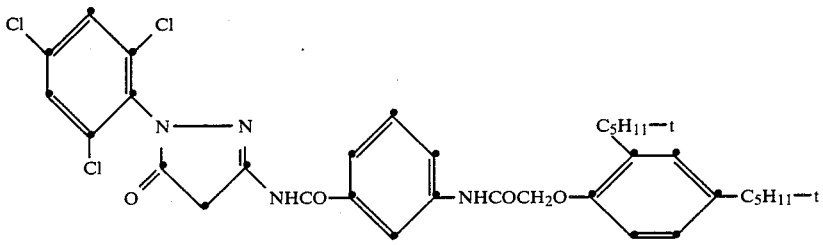

M3

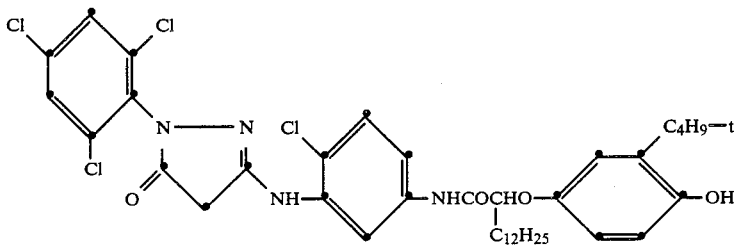

-continued
Y1
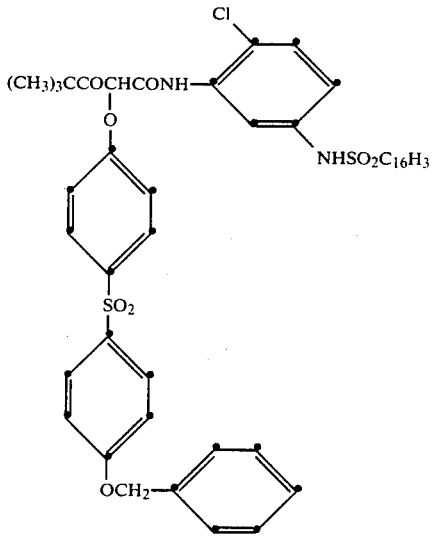
Y2
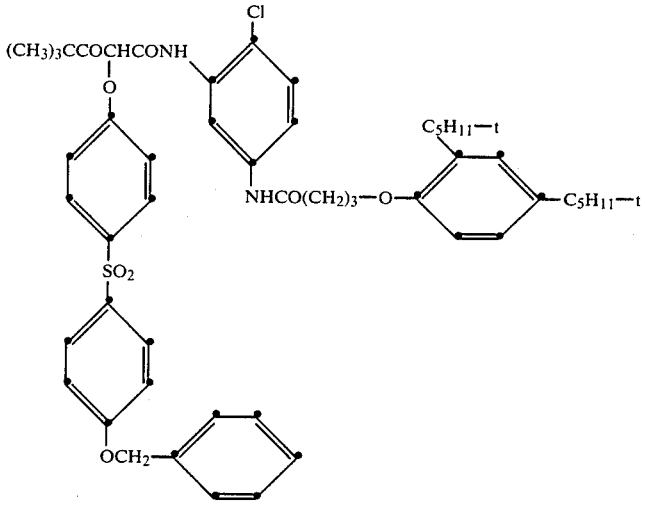
Y3
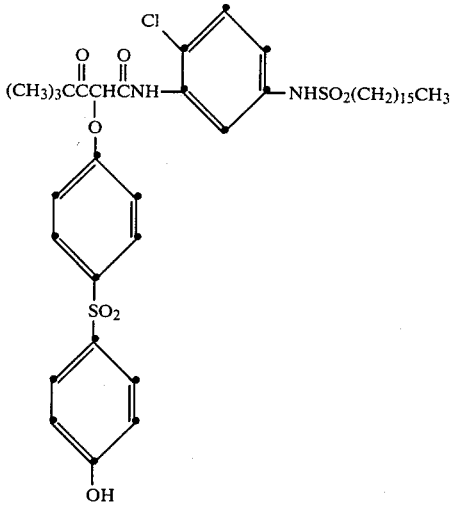
All the above cyan couplers, C1 to C3, have a phenolic hydroxyl group with at least one electron-withdrawing group in a position ortho thereto. The magenta couplers M3 and M4 have a phenolic hydroxyl group in the ballast but this is not of enhanced acidity because the substituted alkoxy group at the para position is not an electron-withdrawing group. The phenolic hydroxyl group in the yellow coupler Y3 is, on the other hand, rendered more acidic by the para sulphonyl group.

Oil-soluble petroleum sulfonates are valuable in the preparation of dispersions of ultraviolet radiation screening compounds. United States patent specifications describing ultraviolet absorbers are given in *Research Disclosure,* Item No. 17643, (see Section VIII paragraph C). Other references are:

| | | | |
|---|---|---|---|
| U.S. Pat. No. | 3,533,794 | U.K. Patent | 1,995,302 |
| | 3,698,907 | | 1,026,142 |
| | 3,705,805 | | 1,112,333 |
| | 3,754,919 | | 1,112,898 |

A dispersion of a mixture of a coupler, especially a cyan dye-forming coupler, and an ultraviolet absorber made with an oil-soluble petroleum sulfonate, but without an oil-former, can give excellent results.

Preferred ultraviolet absorbers for incorporation in photographic layers, alone or mixed with a coupler as described, are 2-(2-hydroxyphenyl) benzotriazoles. Examples of such ultraviolet absorbing compounds are the following, which are used in the Examples hereinafter.

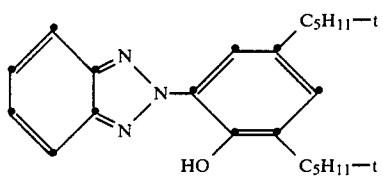

U1

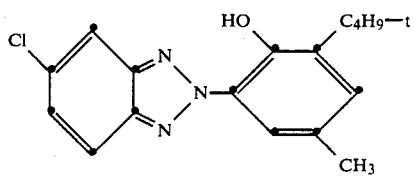

U2

The compounds U1 and U2 are available commercially under the trademarks "Tinuvin 328" and "Tinuvin 326" respectively.

An addendum dispersion of the invention can be made by a variety of methods, the oil-soluble petroleum sulfonate being added at any stage. If the petroleum sulfonate is used as the sole dispersing agent, it is preferably mixed with the addendum before dispersion in the aqueous hydrophilic colloid is commenced. It can be used with a conventional, less lipophilic, anionic surfactant in which case, the petroleum sulfonate may be present during the dispersion step or may be added afterwards, i.e. to the dispersion obtained using the conventional surfactant.

Many types of anionic surfactant can be used in dispersion manufacture. The less lipophilic agents recommended for use in methods of the present invention have either a single aliphatic hydrocarbon group with no more than 14 carbon atoms, or two or more aliphatic hydrocarbon groups which together contain a maximum of 16 carbon atoms, the hydrophilic group or groups being provided by sulphate groups usually in the form of ammonium or alkali metal salts. Alkylaryl-sulfonates and sulphopolycarboxylic esters are very satisfactory.

If an oil-former is included in a dispersion of the invention, this may be any of the usual involatile organic liquids, or low melting solids, which do not adversely affect desired photographic properties. Examples are listed in United Kingdom patent specification No. 541,589 and include the well known coupler solvents dibutyl phthalate and tricresyl phosphate.

Techniques wherein a water-miscible organic solvent or a volatile water-immiscible organic solvent is present during the dispersion step, as an "auxiliary solvent", and is then removed by washing of the set dispersion, or by evaporation, may be employed in the making of dispersions of the present invention. Such techniques are described in United Kingdom patent specification No. 791,219 and U.S. Pat. No. 2,801,171.

It is preferred, whenever the nature of the addendum allows, not to employ an oil-former in a dispersion of the invention so as to avoid the disadvantages mentioned above.

The amount of oil-soluble petroleum sulphonate in a dispersion of the invention is preferably from 10 to 100% of the weight of the dispersed oleophilic compound or mixture, but a smaller amount may be present, for instance down to 1% of the weight of dispersed oleophilic material, if the petroleum sulfonate is used primarily as a dispersing agent.

A dispersion of the invention is incorporated in a photographic material in the normal manner known in the photographic art by mixing the required amount with the other constituents of a composition to be coated on the chosen support. In the case of a sensitive photographic material, the composition may be a gelatino-silver halide photographic emulsion, especially where the dispersed addendum is a coupler or dye-releasing compound.

Coupler dispersions of the invention offer a number of advantages, according to their nature and composition. When a coupler dispersion having no oil-former is prepared, both the mechanical and the optical properties of the layer in which this is incorporated are improved. Thus the layer may be thinner and tougher and the cloudiness of the wet layer due to the difference in refractive index of the dispersed droplets and the hydrophilic colloid vehicle may be reduced or even eliminated. As noted above, the dark stability of cyan dyes formed from certain cyan coupler dispersions of the invention can be enhanced. Also a coupler-solvent free mixture of a phenolic cyan coupler and a benzotriazole ultraviolet absorber can be dispersed to give a dispersion from which images of enhanced density and stability can be produced.

The invention is illustrated by the following examples.

EXAMPLE 1

This example illustrates the preparation of dispersion and coatings of the ultraviolet absorber Compound U1.

Compound U1, 1.0 g; 2,5-di-isooctyl hydroquinone, 0.07 g; and the petroleum sulfonate "Petronate L" (Trademark, Witco Ltd) as stated in Table 1, were melted together at approximately 90° C. The resulting oily solution was mechanically dispersed, using a small homogeniser supplied by Silverson Machines Ltd., into 9.4 ml of 8% w/w aqueous gelatin solution containing 0.04 g of the surfactant tri-isopropyl naphthalene sulfonate. 1.0 g of the resulting dispersion was then mixed with 8 ml of 3% w/w gelatin solution and that mixture coated at a wet thickness of approximately 0.10 mm on -continued
Y1
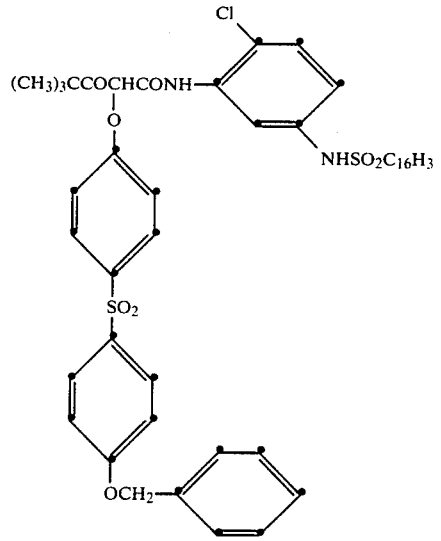
Y2
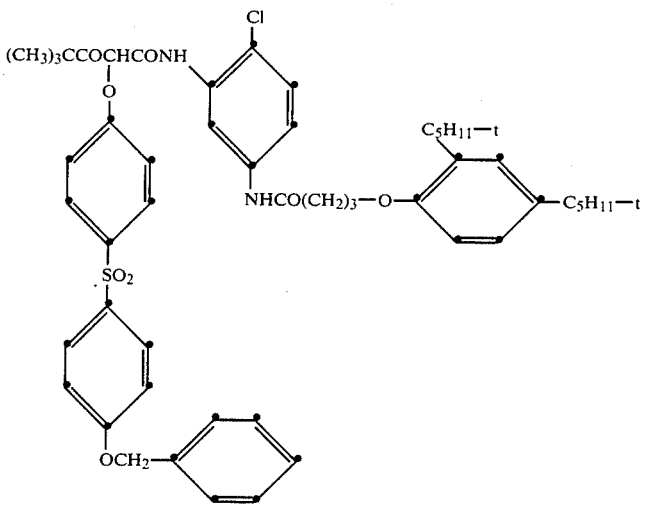
Y3
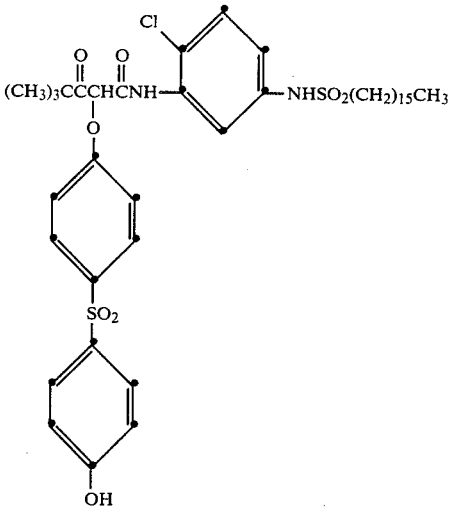
All the above cyan couplers, C1 to C3, have a phenolic hydroxyl group with at least one electron-withdrawing group in a position ortho thereto. The magenta couplers M3 and M4 have a phenolic hydroxyl group in the ballast but this is not of enhanced acidity because the substituted alkoxy group at the para position is not an electron-withdrawing group. The phenolic hydroxyl group in the yellow coupler Y3 is, on the other hand, rendered more acidic by the para sulphonyl group.

Oil-soluble petroleum sulfonates are valuable in the preparation of dispersions of ultraviolet radiation screening compounds. United States patent specifications describing ultraviolet absorbers are given in *Research Disclosure,* Item No. 17643, (see Section VIII paragraph C). Other references are:

| | | | |
|---|---|---|---|
| U.S. Pat. No. | 3,533,794 | U.K. Patent | 1,995,302 |
| | 3,698,907 | | 1,026,142 |
| | 3,705,805 | | 1,112,333 |
| | 3,754,919 | | 1,112,898 |

A dispersion of a mixture of a coupler, especially a cyan dye-forming coupler, and an ultraviolet absorber made with an oil-soluble petroleum sulfonate, but without an oil-former, can give excellent results.

Preferred ultraviolet absorbers for incorporation in photographic layers, alone or mixed with a coupler as described, are 2-(2-hydroxyphenyl) benzotriazoles. Examples of such ultraviolet absorbing compounds are the following, which are used in the Examples hereinafter.

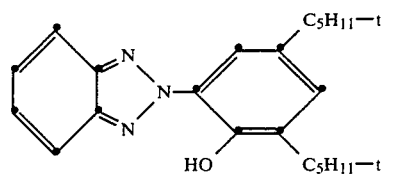

U1

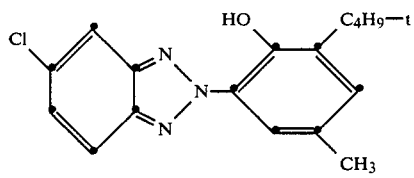

U2

The compounds U1 and U2 are available commercially under the trademarks "Tinuvin 328" and "Tinuvin 326" respectively.

An addendum dispersion of the invention can be made by a variety of methods, the oil-soluble petroleum sulfonate being added at any stage. If the petroleum sulfonate is used as the sole dispersing agent, it is preferably mixed with the addendum before dispersion in the aqueous hydrophilic colloid is commenced. It can be used with a conventional, less lipophilic, anionic surfactant in which case, the petroleum sulfonate may be present during the dispersion step or may be added afterwards, i.e. to the dispersion obtained using the conventional surfactant.

Many types of anionic surfactant can be used in dispersion manufacture. The less lipophilic agents recommended for use in methods of the present invention have either a single aliphatic hydrocarbon group with no more than 14 carbon atoms, or two or more aliphatic hydrocarbon groups which together contain a maximum of 16 carbon atoms, the hydrophilic group or groups being provided by sulphate groups usually in the form of ammonium or alkali metal salts. Alkylaryl-sulfonates and sulphopolycarboxylic esters are very satisfactory.

If an oil-former is included in a dispersion of the invention, this may be any of the usual involatile organic liquids, or low melting solids, which do not adversely affect desired photographic properties. Examples are listed in United Kingdom patent specification No. 541,589 and include the well known coupler solvents dibutyl phthalate and tricresyl phosphate.

Techniques wherein a water-miscible organic solvent or a volatile water-immiscible organic solvent is present during the dispersion step, as an "auxiliary solvent", and is then removed by washing of the set dispersion, or by evaporation, may be employed in the making of dispersions of the present invention. Such techniques are described in United Kingdom patent specification No. 791,219 and U.S. Pat. No. 2,801,171.

It is preferred, whenever the nature of the addendum allows, not to employ an oil-former in a dispersion of the invention so as to avoid the disadvantages mentioned above.

The amount of oil-soluble petroleum sulphonate in a dispersion of the invention is preferably from 10 to 100% of the weight of the dispersed oleophilic compound or mixture, but a smaller amount may be present, for instance down to 1% of the weight of dispersed oleophilic material, if the petroleum sulfonate is used primarily as a dispersing agent.

A dispersion of the invention is incorporated in a photographic material in the normal manner known in the photographic art by mixing the required amount with the other constituents of a composition to be coated on the chosen support. In the case of a sensitive photographic material, the composition may be a gelatino-silver halide photographic emulsion, especially where the dispersed addendum is a coupler or dye-releasing compound.

Coupler dispersions of the invention offer a number of advantages, according to their nature and composition. When a coupler dispersion having no oil-former is prepared, both the mechanical and the optical properties of the layer in which this is incorporated are improved. Thus the layer may be thinner and tougher and the cloudiness of the wet layer due to the difference in refractive index of the dispersed droplets and the hydrophilic colloid vehicle may be reduced or even eliminated. As noted above, the dark stability of cyan dyes formed from certain cyan coupler dispersions of the invention can be enhanced. Also a coupler-solvent free mixture of a phenolic cyan coupler and a benzotriazole ultraviolet absorber can be dispersed to give a dispersion from which images of enhanced density and stability can be produced.

The invention is illustrated by the following examples.

EXAMPLE 1

This example illustrates the preparation of dispersion and coatings of the ultraviolet absorber Compound U1.

Compound U1, 1.0 g; 2,5-di-isooctyl hydroquinone, 0.07 g; and the petroleum sulfonate "Petronate L" (Trademark, Witco Ltd) as stated in Table 1, were melted together at approximately 90° C. The resulting oily solution was mechanically dispersed, using a small homogeniser supplied by Silverson Machines Ltd., into 9.4 ml of 8% w/w aqueous gelatin solution containing 0.04 g of the surfactant tri-isopropyl naphthalene sulfonate. 1.0 g of the resulting dispersion was then mixed with 8 ml of 3% w/w gelatin solution and that mixture coated at a wet thickness of approximately 0.10 mm on polyethylene terephthalate photographic film base, and the coating dried.

The coatings were examined: the coating without any petroleum sulfonate surfactant was quite opaque and clearly contained crystalline matter. The other coatings graduated from milky to glass clear in appearance as the petroleum sulfonate surfactant concentration increased.

After seven and a half months keeping under normal room conditions the coatings were re-examined and found not to have changed significantly. A measure of opacity or light-scattering was obtained by measuring the "absorbance" of the sample, at 500 nm in a spectrophotometer, and a measure of the density to ultraviolet radiation was obtained by measuring its absorbance at 350 nm. These values are listed in Table 1, and it will be seen that the petroleum sulfonate surfactant promoted low light scattering and high ultraviolet light absorbing efficiency.

TABLE 1

| Coating | "Petronate L" added, g | Absorbance at 500 nm | Absorbance at 350 nm |
|---|---|---|---|
| plain film base | | 0.044 | 0.063 |
| UV absorber | 0.00 | 0.235 | 0.80 |
| " | 0.20 | 0.116 | 2.68 |
| " | 0.30 | 0.082 | 2.70 |
| " | 0.40 | 0.083 | 2.90 |
| " | 0.50 | 0.060 | 2.86 |

EXAMPLE 2

This example is similar to Example 1 except the petroleum sulfonate was partially combined with the bulky ion-pairing quaternary benzyl tributyl ammonium ion after preparation of the dispersion.

Compound U1, 10.0 g; 2,5-di-isooctyl hydroquinone, 0.7 g; and "Petronate L" 5.0 g (approximately 7.5 m mol) were melted together and the resulting oily solution mechanically dispersed into 70 ml of 1.8% w/w gelatin solution to which had been added 0.4 g of triisopropyl naphthalene sulfonate. With the homogenizing device still running, 5.0 ml of a 21.5% w/v aqueous solution of benzyl tributyl ammonium acetate (approximately 3 m mol) were run into the dispersion.

A coating was prepared by mixing together 1.2 g of dispersion, 7.5 ml of 2.5% w/w aqueous gelatin solution, and 0.3 ml of 5% w/v aqueous chromium sulphate solution, and coating the mixture at approximately 0.1 mm wet thickness on photographic film base.

The result was a glass-clear, crystal-free coating having an ultraviolet optical density (at 350 nm) of 2.8. The coating was not affected by passing through a normal color negative photographic paper process (develop, bleach-fix and wash) followed by seven months keeping under normal room conditions.

EXAMPLE 3

0.5 g Compound U2, 0.5 g Compound U1 and 0.5 g of "Petronate HL" (Trademark, Witco Ltd.) were melted together to form a clear solution at 120° C. The temperature was reduced to 100° C., amd 8.5 g of 7.4% w/w aqueous gelatin solution added with stirring, and the mixture mechanically dispersed as in Example 1.

1.0 g of the resulting dispersion was mixed with 9.0 g of 2.0% w/w gelatin solution and the mixture coated at 0.1 mm wet thickness on photographic film base. On drying, a reasonably clear coating was obtained having an optical absorbance at 350 nm of 2.1.

EXAMPLE 4

This Example illustrates the preparation of dispersions of couplers which are readily melted, simply by heating the coupler together with a petroleum sulfonate then dispersing into the aqueous phase. Little or no solvent was used. Comparative examples using another surfactant, and of a more conventional type of dispersion using a standard coupler solvent and surfactant, are also given.

Dispersions were prepared as follows:

Coupler Y1: 1.0 g coupler, 0.4 g of dibutyl phthalate, and 0.33 g of surfactant A ("Petronate L") or of surfactant B ("Aerosol TR70"-Trademark- 70% sodium bis tridecyl sulphosuccinate) were heated together at 130° C. When a smooth solution had formed the temperature was reduced to 100° C. and it was dispersed into 7.0 g of 9% w/w aqueous gelatin solution by stirring. The dispersion was then treated with a homogeniser as in Example 1 to give a smooth dispersion of small droplet size. 1.7 ml of water was then stirred in. A conventional comparison dispersion was prepared by dissolving 1.0 g of coupler Y1 in 0.6 g of di-n-butyl phthalate and 0.6 g of ethyl acetate. This solution was dispersed, using the homogeniser, into 7.8 g of 8.0% w/w aqueous gelatin solutions to which had been added 0.04 g of the surfactant sodium tri-isopropyl naphthalene sulfonate.

Coupler M1: 1.0 g of coupler M1 and 0.33 g of Surfactant A or of Surfactant B were heated together to form a smooth solution at 100° C., which was dispersed into gelatin solution just as for Coupler Y1. A conventional comparison dispersion was also prepared as for Coupler Y1.

Coupler C1: 1.0 g of coupler C1 and 0.5 g of Surfactant A or of Surfactant B were heated together to form a smooth solution at 130° C., which was cooled to 1OO° C. and dispersed into gelatin solution just as for coupler Y1.

A conventional comparison dispersion was prepared as for Example 1.

Coatings of each dispersion were prepared by mixing together, under safelight conditions, 1.0 g of dispersion, 0.25 g of silver chlorobromide photographic paper emulsion, 1.5 g of 12.5% w/w/ gelatin, 6.0 ml of water and 0.3 ml of 5% w/v chromic sulphate solution. This mixture was coated at approximately 0.1 mm wet thickness on photographic film base and the coating dried.

Portions of the coatings were exposed to a sensitometric step-wedge and developed in KODAK "Ektaprint 2" developer for 3½ minutes at 31° C., bleach-fixed in "Ektaprint 2" bleach-fixer, and washed for five minutes in running cold water. In Table 2 are listed the maximum transmission densities and the contrast ($\gamma$) obtained from each coating. Densitometry was through the appropriate filter: blue for yellow coupler, green for magenta and red for cyan. The clarity of the background areas is also described, both in words and numerically as the "absorbance" measured at 400 nm in a spectrophotometer, that is a measure of the amount of light scattered in passing through the coating. It will be seen that the coatings according to the invention compared favorably with the comparison coatings both in terms of coating clarity and of sensitometric performance. The photographic speeds measured at ½ (Dmax-Dmin), were very similar for each of the three coatings of any given coupler. ("Kodak" and "Ektaprint" are trademarks of Eastman Kodak Company, U.S.A.)

TABLE 2

| Dispersion Details | | | | | | |
|---|---|---|---|---|---|---|
| Coupler | Surfactant* g | Dibutyl Phthalate | Clarity | Absorbance 400 nm | $\gamma$ | $D_{max}$ |
| Y1 | A, 0.33 | 0.4 g | Clear | 0.086 | 1.04 | 1.45 |
| Y1 | B, 0.33 | 0.4 | Milky | 0.164 | 0.56 | 0.72 |
| Y1 | C, 0.04 | 0.6 | Milky | 0.199 | 0.70 | 0.92 |
| M1 | A, 0.33 | — | Clear | 0.066 | 1.04 | 1.36 |
| M1 | B, 0.33 | — | Some Crystals | 0.072 | 0.83 | 1.07 |
| M1 | C, 0.04 | 0.6 | Clear | 0.072 | 0.77 | 1.02 |
| C1 | A, 0.5 | — | Slightly Turbid | 0.117 | 1.00 | 1.38 |
| C1 | B, 0.5 | — | Milky | 0.185 | 0.65 | 0.95 |
| C1 | C, 0.04 | 0.6 | Milky | 0.244 | 0.61 | 0.80 |

*A: "Petronate L" (petroleum sulfonate surfactant)
B: sodium bis tridecyl sulphosuccinate
C: tri-isopropyl naphthalene sulfonate

EXAMPLE 5

Coupler Y3, 2.0 g and "Petronate L", 0.7 g were melted together at 100° C. Then was added 7.0 g of 9.0% w/w gelatin solution at 95° C., and the coupler was dispersed into it first by stirring then by using the homogeniser. 10 g of water was then added and stirred in.

A coating was made and tested as described in Example 4. The coating was of moderate clarity, gave a maximum transmission density (through a blue filter) of 1.30 and had a contrast of 0.88.

EXAMPLE 6

In this Example, coupler Y2 was dispersed in the presence of an acidic phenol coupler solvent, and the coatings to which hydrophobic surfactant was added therefore illustrate the invention.

Coupler Y2, 1.0 g; n-dodecyl-p-hydroxybenzoate, 0.5 g; n-octyl-p-hydroxybenzoate, 0.5 g; and the petroleum sulfonate "Petronate L" as stated in Table 3 were melted together to form an oily solution. The solution was mechanically dispersed into 7.0 g of 8.9% w/w gelatin solution to which had been added 0.3 g of 10% w/w sodium dioctyl sulphosuccinate surfactant.

Photographic coatings were prepared by combining together, under safelight conditions, 1.5 g of coupler dispersion, 0.4 g of silver chlorobromide photographic paper emulsion (approximately 1.0 M in silver halide), 0.9 g of 12½ w/w aqueous gelatin solution and 5.9 ml of water. 5% w/v chromic sulphate solution, 0.30, ml was added immediately prior to coating on photographic film base at a wet thickness of approximately 0.10 mm.

Portions of dried coating were exposed to room light for 5 s and then developed for 210 s in KODAK "Ektaprint 2" developer at 31° C., bleach-fixed for 60s in KODAK "Ektaprint" Bleach-Fixer, washed for 10 minutes in running water, and dried.

The resulting dye density of each sample was measured with a transmission densitometer through an appropriate, i.e. blue filter. The samples were then incubated in the dark in an oven at 60° C. and 70% relative humidity for four weeks and the dye densities again measured. The percentage fades which had occurred are listed in Table 3.

TABLE 3

| "Petronate L" added | Original Density | % Fade (4 weeks) |
|---|---|---|
| — | 1.26 | 12 |
| 0.3 g | 1.34 | 8 |
| 0.5 g | 1.08 | 3 |

EXAMPLE 7

This example illustrates the use of a petroleum sulfonate surfactant when coupler M3 was dispersed in the presence of an acidic phenol coupler solvent.

Coupler M3, 1.0 g; n-dodecyl-p-hydroxybenzoate, 0.33 g; n-octyl-p-hydroxy-benzoate, 0.33 g; and N, N-diethyl lauramide, 0.33 g, were melted together to form an oily solution. This solution was mechanically dispersed into 7.6 g of 10.5% gelatin solution, to which had been added 0.8 g of 10% w/w sodium dioctyl sulphosuccinate aqueous solution and "Petronate HL" surfactant as stated in Table 4.

Photographic coatings were prepared by combining together, under safelight conditions, 0.8 g of coupler dispersion, 0.25 g of silver chlorobromide photographic paper emulsion (approximately 1.0 M in silver halide), 1.0 g of 12% w/w gelatin aqueous solution, and 6.6 ml of water. 5% w/v chromic sulphate solution, 0.30 ml, was added immediately prior to coating on photographic film base at a wet thickness of approximately 0.10 mm.

Portions of dried coating were exposed, processed and tested as in Example 6: results are given in Table 4. It will be seen that in this and in the previous Example the presence of the petroleum sulfonate improved the dark stability of the dye in the presence of the acidic phenols.

TABLE 4

| Surfactant added | Original Density | % Fade in 12 weeks |
|---|---|---|
| — | 1.24 | 6.5 |
| 0.10 g | 1.39 | 3.6 |
| 0.20 g | 1.36 | 0.7 |
| 0.30 g | 1.37 | 2.2* |

*Density increase

EXAMPLE 8

The coupler used in this example had an acidic phenol leaving group. The results show how the dark stability of the image dye was most diminished in areas of low image density, where most acidic phenol remained. The stabilising effect of the petroleum sulfonate surfactant is illustrated: the effects varied with the humidity at which the accelerated dark fading was carried out.

Dispersions of coupler Y3 were prepared by dissolving coupler, 1.5 g, in di-n-butyl phthalate, 0.9 g, and ethyl acetate, 0.9 g, and mechanically dispersing the resultant solution in 15 g of 9.2% w/w gelatin to which had been added 10% sodium triisopropyl naphthalene sulfonate, 0.6 ml.

1.0 g portions of dispersion were taken and 0.3 ml of water or of a solution of hydrophobic surfactant added (see below) and the mixture held for 20 minutes at 40° C.

Photographic coatings were prepared by combining together, under safelight conditions, the treated portion of coupler dispersion, 1.5 g of 12½% w/v aqueous gelatin solution, 0.25 ml of photographic paper type silver chlorobromide emulsion (approximately 1.0 M in silver halide) and 5.7 ml water.

The coatings were exposed to a photographic step wedge and processed as in Example 6. The image densities of the various steps of the image were measured (blue filter). The strips were incubated either for 60 days at 60° C., 70% RH or for 28 days at 77° C., low RH. Results are given in Table 5; coating A had 0.3 ml water added, and coating B had 0.3 ml 10% Petronate HL.

TABLE 5

| | 60 Days 60° C. 70% RH | | 28 Days 77° C., low RH | |
|---|---|---|---|---|
| | Initial Step Density | % Fade | Initial Step Density | % Fade |
| A | 0.35 | 26 | 0.39 | 38 |
| | 0.67 | 33 | 0.71 | 37 |
| | 0.97 | 28 | 1.02 | 34 |
| | 1.37 | 20 | 1.42 | 23 |
| | 1.76 | 11 | 1.82 | 12 |
| | 1.90 | 7 | 1.98 | 3 |
| B | 0.58 | 12 | 0.54 | 18 |
| | 0.88 | 16 | 0.88 | 16 |
| | 1.20 | 14 | 1.20 | 11 |
| | 1.57 | 14 | 1.58 | 5 |
| | 2.07 | 13 | 2.07 | 2 |
| | 2.11 | 12 | 1.99 | 1 |

EXAMPLE 9

This example illustrates the use of a codispersion of a cyan dye-forming coupler with a 2-(2'-hydroxyphenyl) benzotriazole ultraviolet light absorbing agent using a petroleum sulfonate surfacant.

To 1.0 g of coupler C3 was added Compound U1, di-n-butyl phthalate, and surfactant as stated in Table 6. These components were dissolved together by heating and stirring, and the resulting oily solution was mechanically dispersed into 8.0 g of 7.8% w/w aqueous gelatin solution.

Seven coatings were prepared, under safelight conditions, by mixing together 1.0 g of dispersion, 0.2 g of silver chlorobromide photographic paper emulsion (1.0 M in silver), 7.3 ml of 2.5% w/w aqueous gelatin solution, and 0.3 ml of 5% w/v aqueous chromic sulphate solution. This mixture was coated at approximately 0.1 mm wet thickness on photographic film base and the coating dried.

Portions of the coatings were exposed and processed for 3½ minutes in KODAK "Ektaprint 2" developer followed by 90 s in KODAK "Ektaprint 2" bleach-fix, both at 31° C., and then washed in cold running water for ten minutes.

The stability of the resulting cyan dye images under dark incubation conditions was assessed by incubation at 60° C. and 70% relative humidity for a period of ten weeks. Results are given in Table 6, and it will be seen that co-dispersion with the ultraviolet absorber gave improved dye stablilty.

TABLE 6

| No. | Ul (g) | di-n-butyl phthalate (g) | Surfactant (g) | 10 wks 60° C. 70% RH Orig. D | % fade |
|---|---|---|---|---|---|
| i | 1.0 | — | A, 0.5 | 2.08 | 0.5 |
| ii | 0.7 | — | A, 0.5 | 2.16 | 0.9 |
| iii | 0.5 | — | A, 0.5 | 2.27 | *2.2 |
| iv | 0.7 | 0.3 | A, 0.5 | 1.87 | 2.1 |
| v | 0.5 | 0.5 | A, 0.5 | 2.24 | 4.0 |
| vi | — | 1.0 | A, 0.5 | 2.01 | 5.0 |

TABLE 6-continued

| No. | Ul (g) | di-n-butyl phthalate (g) | Surfactant (g) | 10 wks 60° C. 70% RH Orig. D | % fade |
|---|---|---|---|---|---|
| vii | — | 0.5 | B, 0.5 | 1.67 | 4.8 |

A = "Petronate L" - petroleum sulfonate
B = "Aerosol TR70" (Trademark), 70% solution of sodium bis tridecyl sulphosuccinate
*density increase Some optical properties of the coatings were also assessed. All except vii were glass-clear after processing; vii was milky in appearance. Light scattering from both image and non-image areas was estimated by oiling the coated layer to a clear window in a piece of transparent "Perspex" (Trademark) which was otherwise coated in black paint, and then measuring the light reflected back with a reflection densitometer. The observed values are listed in Table 7 as reflection density and the corresponding percentage reflectance. It will be noted that the dispersions having ultraviolet absorber codispersed with coupler in the presence of petroleum sulfonate showed particularly low reflectance in the image areas, and a correspondingly high maximum reflection density.

The optical density (due mainly to the ultraviolet absorber) at 350 nm, in background areas of the coatings is also listed.

TABLE 7

| | Background (non-image) areas | | | | Image areas | |
|---|---|---|---|---|---|---|
| Coating | Dtrans 350 nm | Drefl. (red) | % reflectance | Image Dtrans | Drefl. (red) | % reflectance |
| i | 2.82 | 3.33 | 0.047 | 1.51 | 3.48 | 0.033 |
| ii | 2.16 | 3.33 | 0.047 | 1.41 | 3.44 | 0.036 |
| iii | 1.77 | 3.32 | 0.048 | 1.78 | 3.45 | 0.035 |
| iv | 2.08 | 3.35 | 0.045 | 1.50 | 3.38 | 0.042 |
| v | 1.81 | 3.31 | 0.049 | 1.57 | 3.33 | 0.047 |
| vi | 0.16 | 3.16 | 0.069 | 1.90 | 2.89 | 0.13 |
| vii | 0.27 | 2.98 | 0.10 | 1.52 | 2.72 | 0.19 |

EXAMPLE 10

This example illustrates the use of dispersions according to the invention in a negative-working color paper.

Four lower layers as described in Table 8 were coated with a coating machine onto polyethylene coated photographic paper base.

The couplers, interlayer scavenger and ultraviolet absorber were all coated as conventional oil-in-water dispersions except in layer 5, coating B, and the silver chlorobromide emulsions were all conventional chemically and spectrally sensitized photographic paper emulsions as known in the photographic art. The coating according to the invention, coating B differed from the comparison coating of the prior art, A only in the fourth and fifth layers.

The cyan coupler dispersion for the fifth layer of the comparison coating (A) was made by dissolving together coupler C2 10 g and di-n-butyl phthalate, 5.5 g, and mechanically dispersing the resultant oily solution into 87 g of 11.5% w/w aqueous gelatin solution in which was dissolved tri-isopropyl naphthalene sulfonate, 4.4 g.

70 g of this dispersion and 22 g of red-sensitised silver chlorobromide emulsion (approximately 1 M in silver halide) were mixed together with 457 g of water in which were dissolved 12.3 g gelatin and 1.5 g of bis(-vinylsulphonylmethyl) ether (hardener) and the mixture immediately coated at 58 $cm^3/m^2$ on top of layer 4 of coating A. At the same time the supercoat, layer 6, was coated by coating 10% w/w gelatin solution at 10 $cm^3/m^2$ on top of layer 5.

The cyan dispersion for the coating illustrating the invention, coating B, was prepared by dissolving together, with heating to 130° C., coupler C2, 50 g, ultraviolet absorber compound U1, 50 g, and "Petronate L" surfactant 30 g, and mechanically dispersing the resultant oily solution into 370 g of 3.4% w/w gelatin solution.

412 g of this dispersion and 133 g of red-sensitized silver chlorobromide emulsion (approxmately 1 M in silver bromide) were mixed together with 2855 g water in which were dissolved 75 g gelatin and 9 g bis(vinylsulphonylmethyl) ether and the mixture immediately coated at 58 $cm^3m^2$ on top of layer 4 of coating B. A supercoat was simultaneously applied as above.

The resulting coating structures are shown in Table 8.

TABLE 8

Coating structures. Figures represent aim coated quantities, in $mg/m^2$.

| Layer | Coating A (comparison) | Coating B (invention) |
|---|---|---|
| 6 | gelatin, 1000 | gelatin, 1000 |
| 5 | coupler C2, 660, in dibutylphthalate, 360 red-sensitive silver chlorobromide, 270 (as Ag) gelatin, 2020 | coupler C2, 660; U1 660 red-sensitive silver chlorobromide, 270 (as Ag) gelatin, 2020 |
| 4 | U1, 740; scavenger, 50 gelatin, 1450 | scavenger, 50 gelatin, 1050 |
| 3 | coupler M3, 450; stabilizer, 188; scavenger, 48, in tricresyl phosphate, 242; green-sensitive silver chlorobromide, 470 (as Ag) gelatin, 1800 | |
| 2 | scavenger, 50 gelatin, 1050 | |
| 1 | coupler Y2, 1000, in dibutyl phthalate, 275; blue-sensitive silver chlorobromide, 400 (as Ag); gelatin, 2000 | |
| | PAPER BASE | |

stabilizer:

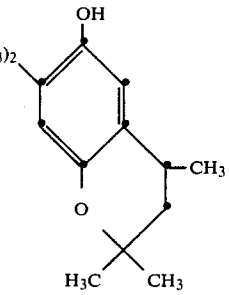

Portions of the coatings were exposed to a sensitometric step wedge giving white, blue, green and red light exposures. They were developed for 3½ minutes in KODAK "Ektaprint 2" developer at 31° C., bleach-fixed for 90 s in "Ektaprint 2" bleach-fix at 31° C., and washed for 10 minutes in cold running water.

Both coatings showed clear yellow, magenta, cyan and neutral images of the step wedge. The maximum densities in the neutral image were read with a "Macbeth" (Trademark) RD519 reflection densitometer, and also in transmission mode with a "Macbeth" TD504 Transmission densitometer. In the latter case the densities were measured through the paper base, the density due to the base being subtracted from the total density read. Results are given in Table 9.

TABLE 9

| Coating | A | (comparison) | | B | (Invention) | |
|---|---|---|---|---|---|---|
| Filter | Blue | Green | Red | Blue | Green | Red |
| $D_{max}$ Refln. | 2.51 | 2.41 | 2.40 | 2.51 | 2.78 | 3.16 |
| $D_{max}$ Trans. | 1.92 | 2.11 | 2.46 | 1.66 | 1.76 | 2.53 |

It will be seen that the coating according to the invention showed substantial increases in both red and green reflection densities, although the total quantity of dye developed, as shown by the transmission densities, was only slightly greater in the red and was less in the green. It is believed that this improved performance in reflection density is due to the elimination of red and green light scattering by cyan image dye, as illustrated in Example 9.

The stability of the cyan image dye under dark conditions was assessed by incubating processed step-wedges at 60° C. and 70% relative humidity (RH), and at 77° C. with no added humidity. Results for the cyan separation wedge are given in Table 10: densities were measured by reflection through a red filter.

TABLE 10

| | 60° C. 70% RH | | 77° C. low RH | |
|---|---|---|---|---|
| Coating | Original D | % loss, 40 days | Original D | % loss, 14 days |
| A | 0.57 | 30 | 0.63 | 32 |
| (comparison) | 0.87 | 21 | 0.97 | 35 |
| | 1.80 | 23 | 1.90 | 32 |
| | 2.15 | 18 | 2.17 | 25 |
| B | 0.52 | 12 | 0.54 | 20 |
| (invention) | 0.75 | 12 | 0.84 | 19 |
| | 1.26 | 12 | 1.34 | 19 |
| | 2.07 | 8 | 2.14 | 15 |

EXAMPLE 11

Compound U1, 1.0 g and 0.35 g surfactant as stated in Table 11 were melted together, except in the case of coatings v and vi, when the surfactant could not be dissolved into the molten compound. The resulting molten oil phase was mixed with an aqueous phase at 95° C. and the mixture homogenised as in Example 1 to give an oil-in-water dispersion. The aqueous phase consisted of 5.0 ml aqueous phase consisted of 10% gelatin solution plus 3.5 ml of water, except in the case of coatings v and vi when the surfactant was dissolved in the water.

1.0 g of the resulting dispersion was mixed with 8.0 g of 4.7% aqueous gelatin solution and the mixture coated at 75 μm wet thickness on a polyester film base. The resulting coatings of ultraviolet absorber were examined for clarity and the results are listed in the Table.

TABLE 11

| COATING | SURFACTANT | CLARITY |
|---|---|---|
| i | "Petronate L" (see Example 1) | Clear |
| ii | "Aerosol TR70" (see Example 4) | Turbid |
| iii | Sodium bis (2-ethylhexyl) sulphosuccinate | Clear |
| iv | "Hostaspur" SAS60 (see below) | Turbid |
| v | Sodium Lauryl Sulphate | Turbid |
| vi | Sodium tri-isopropyl naphthalene sulfonate | Turbid |
| vii | Sodium dodecyl benzene sulfonate | Inter- |

TABLE 11-continued

| COATING | SURFACTANT | CLARITY |
|---|---|---|
| | | mediate |

Notes:
Sufficient of the surfactant sample was added to give 0.35 g of sodium surfactant salt, taking into account the known concentration of surfactant salt in the sample.
"Hostapur" SAS60 (Trademark, Hoechst UK Ltd: sodium n-alkane sulfonate, $C_{13}$–$C_{18}$.

It will be seen that only the surfactant as specified for the invention, "Petronate L", and sodium bis-(2-ethylhexyl) sulphosuccinate gave clear coatings: microscopic examination showed these coatings to have the smallest particle size and the fewest crystals. After two weeks keeping under normal room conditions, however, coating iii was much less clear and microscopic examination showed it to be substantially crystallised, while coating i, containing the surfactant as specified for the invention, remained unchanged.

The invention has been described in detail with particular reference to preferred embodiments thereof, but it will be understood that variations and modifications can be effected within the spirit and scope of the invention.

What is claimed is:

1. A photographic element comprising a support bearing at least one layer comprising a dispersion of a water-insoluble photographic addendum in a hydrophilic colloid, said dispersion containing an oil-soluble petroleum sulfonate which is liquid at 20° C.

2. A photographic element according to claim 1 wherein the addendum is an ultraviolet radiation absorber.

3. A photographic element according to claim 1 wherein the addendum is a photographic dye-forming coupler.

4. A photographic element according to claim 3 wherein the dye-forming coupler contains a phenolic (including naphtholic) moiety in which the acidity of the phenolic hydroxyl group is enhanced by the presence of at least one electron-withdrawing group in a position ortho or para to that group.

5. A photographic element according to claim 3 wherein the dye-forming coupler is dispersed in admixture with an ultraviolet radiation absorber.

6. A photographic element according to claim 1 wherein the weight of the oil-soluble liquid petroleum sulfonate is from 10 to 100% of the total weight of the dispersed addendum and any water-insoluble material dispersed in admixture therewith.

7. A processed photographic element comprising a support bearing at least one layer comprising a developed image and at least one layer comprising a dispersion of a water-insoluble photographic addendum in a hydrophilic colloid composition, said dispersion comprising an oil-soluble petroleum sulfonate which is liquid at 20° C.

* * * * *